US006601593B2

(12) United States Patent
Deiss et al.

(10) Patent No.: US 6,601,593 B2
(45) Date of Patent: Aug. 5, 2003

(54) HOUSEHOLD DISHWASHER

(75) Inventors: Ulrich Deiss, Sontheim (DE); Helmut Jerg, Giengen (DE); Bernd Schessl, Dillingen (DE); Michael Rosenbauer, Reimlingen (DE)

(73) Assignee: BSH Bosch und Siemens Hausgeräte GmbH, Munich (DE)

( * ) Notice: Subject to any disclaimer, the term of this patent is extended or adjusted under 35 U.S.C. 154(b) by 39 days.

(21) Appl. No.: 09/878,666

(22) Filed: Jun. 11, 2001

(65) Prior Publication Data

US 2002/0007843 A1 Jan. 24, 2002

Related U.S. Application Data

(63) Continuation of application No. PCT/EP99/09613, filed on Dec. 7, 1999.

(30) Foreign Application Priority Data

Dec. 10, 1998 (DE) ..... 198 57 103

(51) Int. Cl.[7] ..... B08B 3/02

(52) U.S. Cl. ..... 134/25.2; 134/57 D; 134/58 D; 134/191

(58) Field of Search ..... 134/25.2, 57 D, 134/58 D, 108, 191

(56) References Cited

U.S. PATENT DOCUMENTS 3,868,835 A * 3/1975 Todd-Reeve ..... 68/20
4,741,353 A * 5/1988 Milocco ..... 137/119.03
5,264,043 A * 11/1993 Milocco ..... 134/25.2
5,620,014 A * 4/1997 Milocco et al. ..... 134/108

FOREIGN PATENT DOCUMENTS

EP 0483466 A1 * 5/1992
EP 0547011 A1 * 6/1993
EP 0585905 A2 * 3/1994

* cited by examiner

*Primary Examiner*—Randy Gulakowski
*Assistant Examiner*—Joseph Perrin
(74) *Attorney, Agent, or Firm*—Laurence A. Greenberg; Werner H. Stemer; Ralph E. Locher

(57) ABSTRACT

A household dishwasher, includes a dishwashing compartment, a circulating pump for delivering liquid to the dishwashing compartment, a flow heater having an inflow connection fluidically connected to the circulating pump and at least two outlet connections, spray devices disposed in the dishwashing compartment and fluidically connected to outlet connections for supplying the liquid to each of the spray devices, and a changeover device for selectively opening and closing the spray devices. The spray devices subject items disposed in the dishwashing compartment and to be cleaned to an action of a liquid delivered by the circulating pump. The changeover device is disposed in a non-restricting location at the flow heater upstream of the outlet connections with respect to a liquid flow direction and opens and/or closes one of the outlet connections or a number of outlet connections or all the outlet connections are alternately one after the other and/or on a permanent basis. A method is also provided.

19 Claims, 2 Drawing Sheets

HOUSEHOLD DISHWASHER

CROSS-REFERENCE TO RELATED APPLICATION

This application is a continuation of International Application No. PCT/EP99/09613, filed Dec. 7, 1999, which designated the United States.

BACKGROUND OF THE INVENTION

FIELD OF THE INVENTION

The invention lies in the field of appliances. The invention relates to a household dishwasher with a dishwashing compartment with at least two spray devices that subject items that are disposed in the dishwashing compartment and are to be cleaned to the action of a liquid delivered by a circulating pump.

A household dishwasher is disclosed, for example, from German Published, Non-Prosecuted Patent Application DE 24 28 991 A1. In the case of commercially available household dishwashers, the at least two spray devices are simultaneously charged with the liquid delivered by the circulating pump. In the case of the household dishwasher according to German Published, Non-Prosecuted Patent Application DE 24 28 991 A1, however, to achieve a cleaning result that is equal to or better than that of the commercially available dishwashers outlined above, each spray device is charged alternately one after the other with the liquid delivered by a circulating pump, so that the full pressure of the circulating pump is allowed to act only on one spray device and that a smaller quantity of liquid and lower level of energy for circulating and also for heating the circulated liquid are required. To carry out such a process for alternately charging the spray devices, use is made of changeover devices, usually called water diverters.

European Patent Application EP 05 47 011 A1, for example, discloses the practice of using a hydraulically activated flap valve disposed between liquid-supply lines to the spray devices. The application further discloses alternately opening one of the liquid-supply lines and, at the same time, closing the other liquid-supply lines. The changeover device has a separate housing and is disposed along the course of the liquid-supply lines.

Furthermore, European Patent Application EP 02 37 994 A1, for example, discloses the practice of using a ball in the delivery connection of the circulating pump, which changes position if operation of the circulating pump is interrupted. The application further discloses alternately opening one of the liquid-supply lines and, at the same time, closing the other.

In addition, European Patent 05 85 905, for example, discloses the practice of using a motor-driven, rotating horizontal plate with bores to open one or more accesses to liquid-supply lines and to close others. The changeover device has a separate housing and is disposed along the course of the liquid-supply lines.

The above-mentioned changeover-device solutions are disposed in poorly accessible locations of the household dishwasher and are, thus, difficult to install and/or require a separate housing that has to be disposed in a location of a household dishwasher that additionally restricts the already restricted space conditions of a household dishwasher, e.g., along the course of the liquid-supply lines.

SUMMARY OF THE INVENTION

It is accordingly an object of the invention to provide a household dishwasher that overcomes the hereinaforementioned disadvantages of the heretofore-known devices and methods of this general type and that has a changeover device, for charging spray devices, disposed in a non-restricting location.

With the foregoing and other objects in view, there is provided, in accordance with the invention, a household dishwasher, including a dishwashing compartment, a circulating pump for delivering liquid to the dishwashing compartment, a flow heater having an inflow connection fluidically connected to the circulating pump and at least two outlet connections, at least two spray devices disposed in the dishwashing compartment and fluidically connected to a respective one of the at least two outlet connections for supplying the liquid to each of the at least two spray devices, the at least two spray devices subjecting items disposed in the dishwashing compartment and to be cleaned to an action of a liquid delivered by the circulating pump, a changeover device for selectively opening and closing the at least two spray devices. The changeover device is disposed at the flow heater upstream of the at least two outlet connections with respect to a liquid flow direction. The changeover device is configured to perform a function selected from selectively opening and closing a respective one of the at least two spray devices alternately one after another, selectively opening and closing a number of the at least two spray devices alternately one after another, selectively opening and closing all of the at least two spray devices alternately, selectively opening and closing a respective one of the at least two spray devices on a permanent basis, selectively opening and closing a number of the at least two spray devices on a permanent basis, selectively opening and closing all of the at least two spray devices on a permanent basis, selectively opening and closing a respective one of the at least two spray devices alternately one after another and on a permanent basis, selectively opening and closing a number of the at least two spray devices alternately one after another and on a permanent basis, and/or selectively opening and closing all of the at least two spray devices alternately and on a permanent basis.

The liquid delivered in the invention is directed from the circulating pump to an inflow connection of a flow heater and through the flow heater. The flow heater has at least two outlet connections for supplying the liquid to different spray devices in each case. The spray devices are to be opened and/or closed by a changeover device that is disposed on the flow heater upstream of the outlet connections, as seen in the flow direction, such that either one of the outlet connections or a number of outlet connections or all the outlet connections are opened and/or closed alternately one after the other and/or on a permanent basis.

Because the changeover device is disposed directly at the outlet of the flow heater present, which is anyway, virtually in extension of the outlet connection, the changeover device is disposed in an easily accessible and non-restricting location of the household dishwasher and, thus, can be installed easily. The invention succeeds in providing a household dishwasher of the type mentioned in the introduction having a changeover device, for charging spray devices, disposed in a non-restricting location. Furthermore, a very straightforward construction of the changeover device is possible by virtue of the configuration of a plurality of outlet connections and the alternating and permanent alternative opening and/or closure thereof by the changeover device.

In accordance with another feature of the invention, the number of outlet connections of the flow heater expediently corresponds to the number of spray devices or simultaneously operated groups of spray devices.

According to a preferred embodiment of the invention, the flow heater has two outlet connections.

In accordance with a further feature of the invention, it is possible for an outlet opening of the flow heater, the outlet opening being disposed upstream of each outlet connection, to be closed by a rotary valve of the changeover device. The rotary valve is disposed upstream of the outlet openings, as seen in the flow direction. The prior art changeover devices described in the introduction also have the disadvantage that they are of complicated construction and, thus, are easily susceptible to malfunctioning. Such a disadvantage is overcome by the preferred feature of the invention because even, for example, deposits of dirt cannot disrupt a closing function of the rotary valve as they are pushed away by the rotating rotary valve.

In accordance with an added feature of the invention, the rotary valve has at least one closed region and at least one region that is open by way of a bore. As a result, there is a straightforward production of the rotary valve.

In accordance with an additional feature of the invention, the rotary valve has, alternately in the direction of circulation in each case, an open region followed by a closed region, between which there is an unfilled space. As a result of the configuration, the production of the rotary valve is further simplified and straightforward control of the circulation of the rotary valve is achieved.

In accordance with yet another feature of the invention, the rotary valve is moved, by a drive device, into at least one position in which the at least one closed region or a number of closed regions closes the at least one outlet opening or a number of outlet openings and/or in which all the outlet openings are open. Thus, the rotary valve can be used for all possible methods of charging the spray devices.

In accordance with yet a further feature of the invention, the rotary valve is advantageously in the form of a propeller blade having two mutually opposite regions and being moved, by the drive device, into a position in which the closed region closes an outlet opening and the open region, having a bore, keeps the respectively other outlet opening open. The configuration is the simplest way of control for the simplest case of a household dishwasher with alternate charging of the spray devices, namely with two spray devices.

In accordance with yet an added feature of the invention, the rotary valve a propeller blade having two mutually opposite regions, one of the opposite regions is a closed region, another of the opposite regions is an open region with a bore, the at least two outlet connections is two outlet connections, the flow heater has two outlet openings respectively disposed upstream of each of the two outlet connections in the liquid flow direction, the rotary valve is disposed upstream of the two outlet openings with respect to the liquid flow direction, and a drive device is connected to the propeller blade for moving the propeller blade into a position where the closed region closes one of the two outlet openings and the open region with the bore keeps another of the two outlet openings open.

In accordance with yet an additional feature of the invention, on the regions, the rotary valve particularly advantageously has encircling ribs that project upwards in the direction of the outlet openings in the installed position and have a semicircular cross section. The ribs achieve good outlet-opening-enclosing abutment of the rotary valve against the inner wall of the flow heater and, thus, good sealing of the outlet opening that is to be closed.

In accordance with again another feature of the invention, the drive device is a motor with a gear mechanism. A motor with gear mechanism is a changeover-device drive unit that can be controlled extremely straightforwardly for continuous changeover in the charging of the spray devices and for changeover that takes longer or for permanent opening of one or more supply lines to the spray devices. Further simplification of the changeover device is achieved as a result of the configuration.

In accordance with again a further feature of the invention, the flow heater has an outlet opening disposed upstream of each of the at least two outlet connections in the liquid flow direction, and a speed of the circulating pump is reduced in periods of time when all outlet openings are open and when the at least two spray devices are continuously and alternately charged.

As described in the introduction, continuous, alternate charging of the spray devices is used, in particular, to save water. In the case of a relatively small filling quantity, however, even with brief operation of the two spray devices, the intake chamber of the circulating pump quickly becomes empty, which then, due to the intake of air, results in an unpleasant and undesirable development of noise in the circulating pump. To prevent such noise, in the case of continuous, alternate charging of the spray devices, the speed of the circulating pump is particularly advantageously reduced in the periods of time where both outlet openings are open. With such a measure, the above-described development of noise caused by the intake of air cannot arise because the intake capacity of the circulating pump is reduced to the extent where the intake chamber of the circulating pump does not become empty.

With the objects of the invention in view, there is also provided household dishwasher, including a dishwashing compartment, a circulating pump for delivering liquid to the dishwashing compartment, a flow heater having an inflow connection fluidically connected to the circulating pump and two outlet connections, two spray devices disposed in the dishwashing compartment and fluidically connected to a respective one of the two outlet connections for supplying the liquid to each of the two spray devices, the two spray devices subjecting items disposed in the dishwashing compartment and to be cleaned to an action of a liquid delivered by the circulating pump, a changeover device for selectively opening and closing the two spray devices. The changeover device is disposed at the flow heater upstream of the two outlet connections with respect to a liquid flow direction. The changeover device is configured to perform a function selected from selectively opening and closing a respective one of the two spray devices alternately one after another, selectively opening and closing both of the two spray devices alternately, selectively opening and closing one of the two spray devices on a permanent basis, selectively opening and closing both of the two spray devices on a permanent basis, selectively opening and closing a respective one of the two spray devices alternately and on a permanent basis, and/or selectively opening and closing both of the two spray devices alternately and on a permanent basis.

With the objects of the invention in view, there is also provided a method for washing dishware including the steps of providing a dishwashing compartment with at least two spray devices disposed therein, fluidically connecting an inflow connection of a flow heater to a circulating pump, fluidically connecting the at least two spray devices to a respective one of at least two outlet connections of the flow heater, subjecting dishware disposed in the dishwashing compartment and to be cleaned to an action of a dishwashing liquid by delivering the liquid from the circulating pump through the flow heater, the at least two outlet connections, and the at least two spray devices, and selectively opening and closing the at least two spray devices with a changeover device disposed at the flow heater upstream of the at least two outlet connections with respect to a liquid flow direction. The changeover device is configured to perform a function selected from selectively opening and closing a respective one of said at least two spray devices alternately one after another, selectively opening and closing a number of said at least two spray devices alternately one after another, selectively opening and closing all of said at least two spray devices alternately, selectively opening and closing a respective one of said at least two spray devices on a permanent basis, selectively opening and closing a number of said at least two spray devices on a permanent basis, selectively opening and closing all of said at least two spray devices on a permanent basis, selectively opening and closing a respective one of said at least two spray devices alternately one after another and on a permanent basis, selectively opening and closing a number of said at least two spray devices alternately one after another and on a permanent basis, and selectively opening and closing all of said at least two spray devices alternately and on a permanent basis.

Other features that are considered as characteristic for the invention are set forth in the appended claims.

Although the invention is illustrated and described herein as embodied in a household dishwasher, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
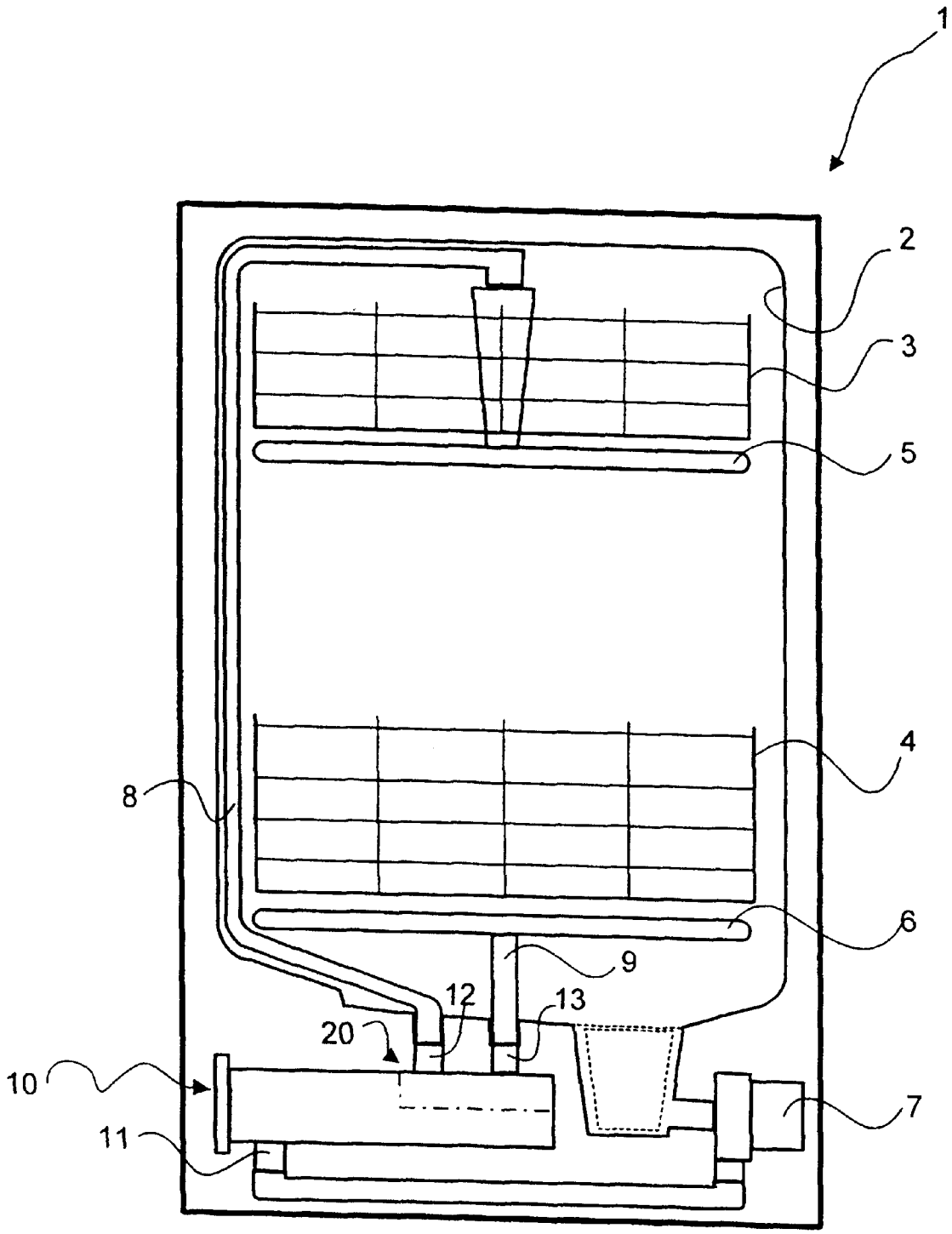
FIG. 1 is a schematic cross-sectional view of a household dishwasher according to the invention.

In all the figures of the drawing, sub-features and integral parts that correspond to one another bear the same reference symbol in each case.

Figure 4:
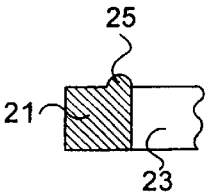
FIG. 4 is an enlarged, fragmentary, cross-sectional view of part of the changeover device of FIG. 2 corresponding to detail IV.

Referring now to the figures of the drawings in detail and first, particularly to FIG. 1 thereof, there is shown a household dishwasher 1 according to the invention having a dishwashing compartment 2 into which non-illustrated items that are to be cleaned, e.g., dirty dishes and cutlery, are introduced, usually into dish racks 3, 4. According to the invention, at least two spray devices, in the exemplary embodiments shown, two spray devices 5, 6, are disposed in the dishwashing compartment 2. The spray devices 5, 6 subject the items that are disposed in the dishwashing compartment 2 and are to be cleaned to the action of liquid. The liquid, usually referred to as dishwashing liquid, is delivered to the spray devices 5, 6 in liquid-supply lines 8, 9 by a circulating pump 7. It is usually the case that the liquid delivered in household dishwashers 1 is heated at least in a sub-program section of a dishwashing program, for which purpose the household dishwasher 1 according to the invention has a flow heater 10. The liquid delivered in the household dishwasher 1 is directed from the circulating pump 7 to an inflow connection 11 of the flow heater 10 and through the flow heater 10. The flow heater 10 has at least two outlet connections, namely a number of outlet connections that corresponds to the number of spray devices or simultaneously operated groups of spray devices. The flow heater 10 has two outlet connections 12, 13 in the exemplary embodiments shown. From the outlet connections 12, 13 of the flow heater 10, the liquid is supplied to the different spray devices 5, 6 respectively through the already mentioned liquid-supply lines 8, 9. The heating elements that are necessary for heating the liquid in the flow heater 10 are designated with numeral 16. See FIGS. 2 and 4.

The outlet connections 12, 13 may be opened and/or closed by a changeover device 20, that is disposed on the flow heater 10 upstream of the outlet connections 12, 13, as seen in the flow direction, such that either one of the respective outlet connections 12, 13 or a number of outlet connections 12, 13 or all the outlet connections 12, 13 are opened and/or closed alternately one after the other and/or on a permanent basis. In the exemplary embodiment shown, the two outlet connections 12, 13 of the flow heater 10 may be opened and/or closed by the changeover device 20 such that either one of the outlet connections 12, 13 or both outlet connections 12, 13 are opened and/or closed alternately one after the other and/or on a permanent basis. For such a purpose, a rotary valve 21 of the changeover device 20 is assigned to outlet openings 14, 15 of the flow heater 10. See FIGS. 2 to 4. The outlet openings 14, 15 are disposed upstream of each outlet connection 12, 13, as seen in the flow direction, and it is possible for a respective one of the outlet openings 14, 15 of the flow heater 10 to be closed by the rotary valve 21. Prior art changeover devices described in the introduction also have a disadvantageous complicated construction and are, thus, easily susceptible to malfunctioning. Such a disadvantage is overcome by the rotary valve 21 of the invention because even, for example, deposits of dirt cannot disrupt a closing function of the rotary valve 21 as they are pushed away by the rotating rotary valve 21. The rotary valve 21 is in the form of a propeller blade having two mutually opposite regions 22, 23. The rotary valve 21 has a closed region 22 and a region 23 that is open by way of a bore. According to the invention, the rotary valve 21 is moved, by a drive device 30, into at least one position in which the at least one closed region 22 or a number of non-illustrated closed regions 22 closes the at least one outlet opening 14, 15 or a number of outlet openings 14, 15, and/or in which all the outlet openings 14, 15 are open. In the exemplary embodiment shown, the rotary valve 21 has two mutually opposite regions 22, 23, a closed region 22 and an open region 23. The rotary valve 21 is moved, by the drive device 30, into a position in which the closed region 22 closes an outlet opening 15 and the open region 23 keeps the other outlet openings 14 open. Such a position is illustrated, for example, in FIG. 2. As can best be seen in FIG. 4, on the regions 22, 23, the rotary valve 21 has encircling ribs 24, 25 that project upward in the direction of the outlet opening 14, 15 in the installed position, have a semicircular cross section, and serve to improve the abutment of the rotary valve 21 against the inner wall of the flow heater 10.

Figure 2:
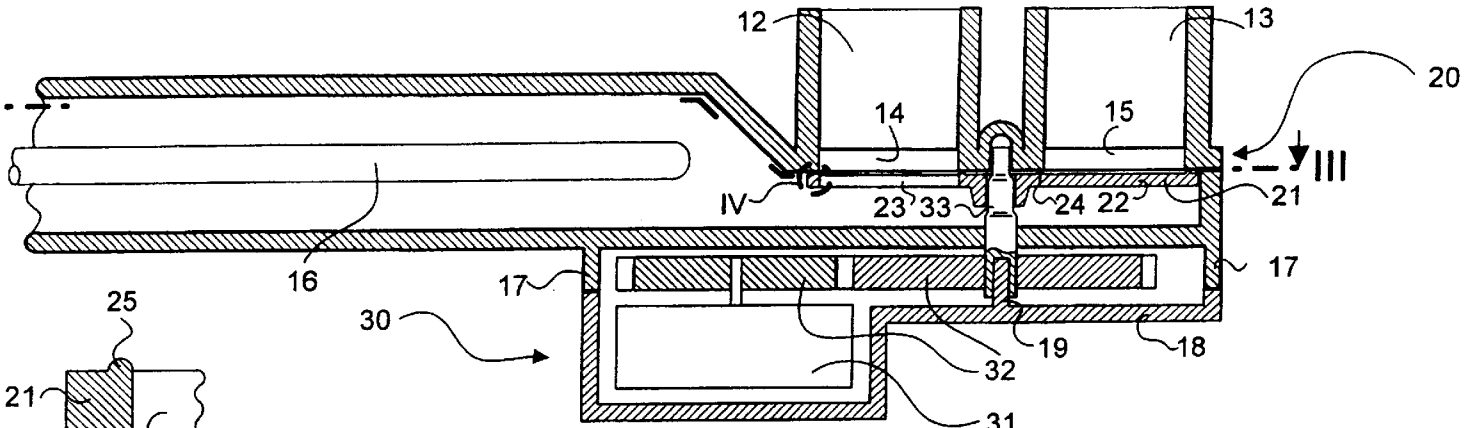
FIG. 2 is a enlarged, fragmentary, cross-sectional view of a flow heater of FIG. 1 with a changeover device according to the invention.

The drive unit 30 is a motor 31, e.g., an electric motor, with a gear mechanism 32, e.g., a toothed-wheel gear mechanism, which is only schematically illustrated in FIG. 2. The rotary valve 21 is connected to the gear mechanism 32 by a shaft 33 that is guided in the housing for the flow heater 10. The motor 30 and the gear mechanism 32 are protected by a cover 18 seated on a raised border 17 of the flow heater 10. The cover 18 also has bearing locations for the gear mechanism 32, of which only one raised bearing journal 19, as a bearing for the shaft 33, is shown.

Figure 3:
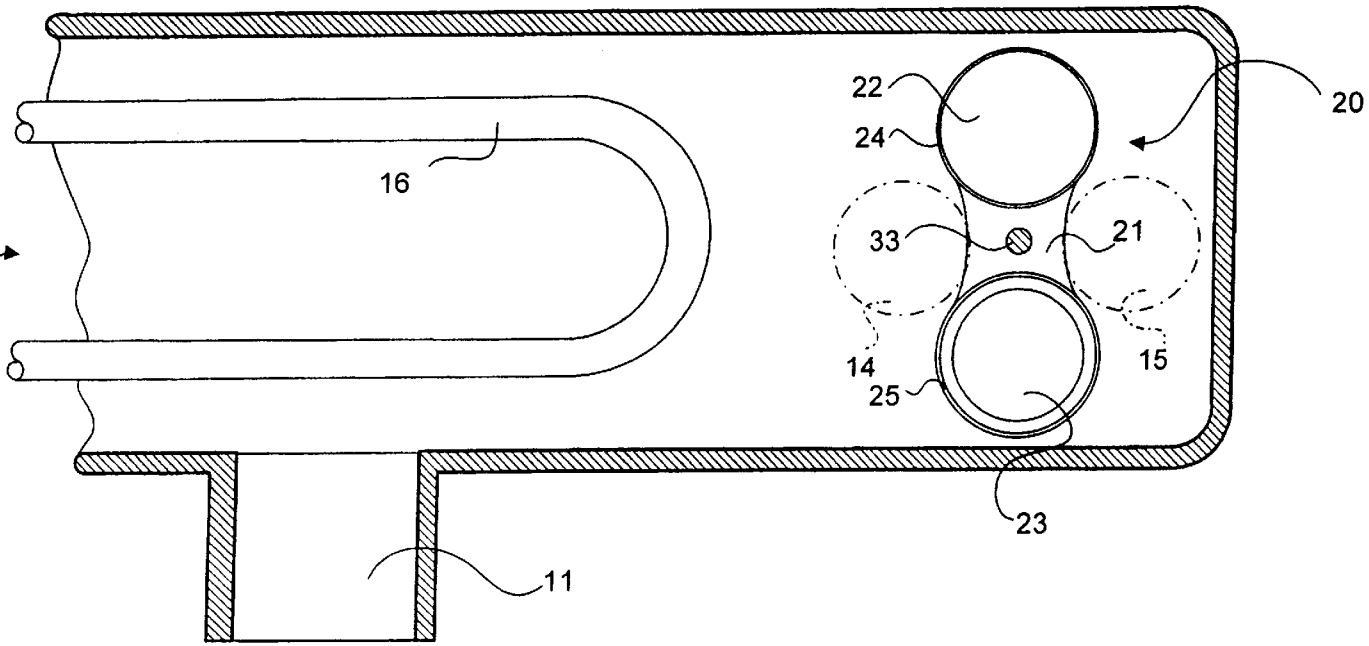
FIG. 3 is a cross-sectional plan view of the flow heater of FIG. 2 along line III—III in FIG. 2.

The functioning of the changeover device 20 according to the invention is explained hereinbelow with reference to the exemplary embodiment shown. If continuous, alternate charging of the spray devices 5, 6 is desired, then the motor 31 of the drive device 30 is connected to a supply voltage by a non-illustrated program-control subassembly (not explained in any more detail) of the household dishwasher 1 and the rotary valve 21 begins to rotate. As a result, the closed region 22 of the rotary valve 21 is rotated until it rests with sealing action on one of the outlet openings 14, 15, on the outlet opening 15 in FIG. 2. In such a position, the feed of liquid flowing through the flow heater 10 to the bottom spray device 6 is interrupted and the feed to the top spray device 5 is opened. See FIG. 2. In the case of continuous, alternate charging of the spray devices 5, 6, the motor 31 continues rotating continuously. As a result, following rotation of the rotary valve 21 through, in the exemplary embodiment, 180°, the closed region 22 rests with sealing action on the outlet opening 14. Consequently, the feed to the top spray device 5 is interrupted and the feed to the bottom spray device 6 is opened. As the motor 31 continues to rotate, the closed region 22 then comes into abutment against the outlet opening 15 again and the operation continues as has been outlined above. With such a method for driving the changeover device, the duration of the opening and/or closing times of the individual feeds to the spray devices 5, 6 is directly dependent on the selected speed of the motor 31 and/or the configuration of the gear mechanism 32. Because the rotary valve 21 has (alternately in the direction of circulation in each case) an open region 23 followed by a closed region 22, between which there is an unfilled space, the rotary valve 21 rotates into a position in which both outlet openings 14, 15 are open (see FIG. 3). The position of the outlet openings 14, 15 that cannot be seen in the view of FIG. 3 are indicated by chain-dotted lines. Thus, for a relatively short period of time, dependent on the speed of the rotary valve 21, the liquid flowing through the flow heater 10 is fed to both spray devices 5, 6. As described in the introduction, continuous, alternate charging of the spray devices 5, 6 is used, in particular, to save water. If a relatively small filling quantity is selected, however, with operation, even brief operation, of both spray devices 5, 6, the intake chamber of the circulating pump 7 quickly becomes empty. The emptying, due to the intake of air, results in an unpleasant and undesirable development of noise in the circulating pump 7. To prevent such an effect, the speed of the circulating pump 7 is reduced, i.e., its intake capacity is reduced, in the periods of time where both outlet openings 14, 15 are open. The reduction results in the elimination of the above-described development of noise because the intake capacity of the circulating pump 7 is reduced to such an extent where the intake chamber of the circulating pump 7 does not become empty.

If, however, it is desired to have continuous, alternate charging of the spray devices 5, 6 where the charging of the individual spray devices 5, 6 is to take longer than in the case of the process described above, then a non-illustrated sensor unit (not described in any more detail) establishes the rotary position of the rotary valve 21 and the motor 31 is switched off for a predetermined period of time through the program-control subassembly. Such shut off results in a maintaining of a respective rotary position of the rotary valve 21 over a period of time.

If, however, it is desired to open only the feeds, for example, to the top spray device 5—also referred to as top-rack dishwashing—on a permanent basis, then the above-described sensor unit is used to operate the motor 31 only until the position for opening the outlet opening 14 for the outlet connection 12 in relation to the liquid-supply line 8 to the top spray device 5 has been reached. The unit is then used to maintain the position throughout the entire dishwashing program because the motor 31 is no longer in operation.

If, finally, the uninterrupted operation of both spray devices is desired, then the above-described sensor unit can be used again to establish the intermediate position for the opening of the two outlet openings 14, 15 and to maintain the intermediate position throughout the entire dishwashing program because the motor 31 is no longer in operation. See FIG. 3. The dishwashing-liquid filling quantity is increased correspondingly.

By virtue of the configuration of the changeover device 20 on the flow heater 10, the invention succeeds in providing a household dishwasher 1 having a changeover device 20, for charging spray devices 5, 6, disposed in a non-restricting location. Furthermore, a very straightforward construction of the changeover device 20 is possible by virtue of the configuration of a plurality of outlet connections 12, 13 on the flow heater 10 and the alternating and permanent alternative opening and/or closure thereof by the changeover device 20.

We claim:

1. A household dishwasher, comprising:

a dishwashing compartment;

a circulating pump for delivering liquid to said dishwashing compartment;

a flow heater having an inflow connection fluidically connected to said circulating pump and at least two outlet connections;

at least two spray devices disposed in said dishwashing compartment and fluidically connected to a respective one of said at least two outlet connections for supplying the liquid to each of said at least two spray devices;

said at least two spray devices disposed to subject items disposed in said dishwashing compartment to be cleaned to an action of a liquid delivered by said circulating pump; and a rotary valve disposed at said flow heater upstream of said at least two outlet connections with respect to a liquid flow direction, for selectively opening and closing said at least two outlet connections.

2. The dishwasher according to claim 1, wherein a number of said at least two outlet connections of said flow heater corresponds to a number of said at least two spray devices.

3. The dishwasher according to claim 1, wherein a number of said at least two outlet connections of said flow heater corresponds to a number of simultaneously operated groups of said at least two spray devices.

4. The dishwasher according to claim 1, where said at least two outlet connections are two outlet connections.

5. The dishwasher according to claim 1, wherein:

said flow heater has an outlet opening disposed upstream of each of said at least two outlet connections in the liquid flow direction; and said rotary valve selectively closes said outlet opening.

6. The dishwasher according to claim 5, wherein that said rotary valve has at least one closed region and at least one open region with a bore.

7. The dishwasher according to claim 6, including a drive device connected to said rotary valve for moving said rotary valve into at least one of different positions selected from the group consisting of:

a position where said at least one closed region closes said outlet opening;

a position where a number of said at least one closed region closes a respective outlet opening; and a position where each outlet opening is open.

8. The dishwasher according to claim 7, wherein said drive device is a motor with a gear mechanism.

9. The dishwasher according to claim 6, wherein:

said rotary valve has encircling ribs at each of said at least one open region and said at least one closed region; and said ribs have a semicircular cross section and project upward in a direction toward said outlet opening in an installed position of said rotary valve.

10. The dishwasher according to claim 5, wherein said rotary valve has a circulation direction and, alternately in said circulation direction, an open region followed by a closed region, said open region and said closed region defining an unfilled space therebetween.

11. The dishwasher according to claim 5, wherein said rotary valve has at least one alternating group of an open region followed by a closed region and said open region and said closed region defining an unfilled space therebetween.

12. The dishwasher according to claim 5, including a drive device connected to said rotary valve for moving said rotary valve into different positions and selectively opening and closing said outlet opening.

13. The dishwasher according to claim 12, wherein said drive device is a motor with a gear mechanism.

14. The dishwasher according to claim 5, wherein:

said rotary valve includes a propeller blade having two mutually opposite regions;

one of said opposite regions is a closed region;

another of said opposite regions is an open region with a bore;

said at least two outlets connections is two outlet connections;

said flow heater has two outlet openings respectively disposed upstream of each of said two outlet connections in the liquid flow direction; and a drive device is connected to said propeller blade for moving said propeller blade into a position where said closed region closes one of said two outlet openings and said open region with said bore keeps another of said two outlet openings open.

15. The dishwasher according to claim 14, wherein said open region and said closed region each have an encircling rib having a semicircular cross section and projecting upward in a direction of said two outlet openings in an installed position of said rotary valve.

16. The dishwasher according to claim 14, wherein said drive device is a motor with a gear mechanism.

17. The dishwasher according to claim 1, wherein:

said flow heater has an outlet opening disposed upstream of each of said at least two outlet connections in the liquid flow direction; and a speed of said circulating pump is reduced in periods of time when all outlet openings are open and when said at least two spray devices are continuously and alternately charged.

18. A household dishwasher, comprising:

a dishwashing compartment;

a circulating pump for delivering liquid to said dishwashing compartment;

a flow heater having an inflow connection fluidically connected to said circulating pump and at least two outlet connections;

two spray devices disposed in said dishwashing compartment and fluidically connected to a respective one of said two outlet connections for supplying the liquid to each of said two spray devices;

said at least two spray devices disposed to subject items disposed in said dishwashing compartment to be cleaned to an action of a liquid delivered by said circulating pump; and a rotary valve disposed at said flow heater upstream of said at least two outlet connections with respect to a liquid flow direction, for selectively opening and closing said at least two outlet connections.

19. A method for washing dishware, which comprises:

providing a dishwashing compartment with at least two spray devices disposed therein;

fluidically connecting at least two outflow connections of a flow heater to the at least two spray devices;

fluidically connecting an inflow connection of the flow heater to a circulating pump;

fluidically connecting the at least two spray devices to a respective one of at least two outlet connections of the flow heater;

subjecting dishware disposed in the dishwashing compartment and to be cleaned to an action of a dishwashing liquid by delivering the liquid from the circulating pump through the flow heater, the at least two outlet connections, and the at least two spray devices; and selectively opening and closing the at least two outlet connections with a rotary valve disposed at the flow heater upstream of the at least two outlet connections with respect to a liquid flow direction, the rotary valve configured to perform a function selected from the group consisting of:

selectively opening and closing a respective one of said at least two outlet connections alternately one after another;

selectively opening and closing a number of said at least two outlet connections alternately one after another;

selectively opening and closing all of said at least two outlet connections alternately;

selectively opening and closing a respective one of said at least two outlet connections on a permanent basis;

selectively opening and closing a number of said, at least two outlet connections on a permanent basis;

selectively opening and closing all of said at least two outlet connections on a permanent basis;

selectively opening and closing a respective one of said at least two outlet connections alternately one after another and on a permanent basis;

selectively opening and closing a number of said at least two outlet connections alternately one after another and on a permanent basis; and selectively opening and closing all of said at least two outlet connections alternately and on a permanent basis.

* * * * *